United States Patent [19]

Reese

[11] Patent Number: 4,466,613

[45] Date of Patent: Aug. 21, 1984

[54] PORTABLE QUADRICEPS EXERCISER

[75] Inventor: John W. Reese, Gaithersburg, Md.

[73] Assignee: Biokinetics, Inc., Bethesda, Md.

[21] Appl. No.: 361,404

[22] Filed: Mar. 24, 1982

[51] Int. Cl.[3] ..... A63B 21/02; A63B 21/04

[52] U.S. Cl. ..... 272/142; 272/134; 272/135; 272/136; 272/DIG. 4

[58] Field of Search ..... 272/132, 134–143; 128/25

[56] References Cited

U.S. PATENT DOCUMENTS

| | | | |
|---|---|---|---|
| 3,120,954 | 2/1964 | Apostol | 272/134 X |
| 3,558,131 | 1/1971 | Dragon | 272/134 |
| 3,664,666 | 5/1972 | Lloyd | 272/135 X |
| 3,893,667 | 7/1975 | Snyder et al. | 272/142 X |
| 4,204,676 | 5/1980 | Givens | 272/142 X |
| 4,254,949 | 3/1981 | Brentham | 272/134 X |
| 4,310,154 | 1/1982 | Kauffman | 272/142 X |

FOREIGN PATENT DOCUMENTS

| | | | |
|---|---|---|---|
| 750826 | 1/1967 | Canada | 272/134 |
| WO81/02524 | 9/1981 | PCT Int'l Appl. | 272/117 |

OTHER PUBLICATIONS

"Taylor at Work", *Washington Post,* Jun. 21, 1972, p. D1.

*Primary Examiner*—Richard J. Apley
*Assistant Examiner*—Chris Coppens
*Attorney, Agent, or Firm*—Epstein & Edell

[57] ABSTRACT

A portable quadriceps muscle exerciser includes a frame member on which a user sits with one buttock and thigh so that the lower leg dangles from the knee joint at the forward end of the device. Spaced bracket members project on opposite sides of the knee and pivotally support a pair of spaced arm members about a pivot axis which is substantially coaxial with the bending axis of the knee joint. The distal ends of the arm members are connected by a cross-piece which engages the patient's instep. One or more elastic straps extend between the frame member and the distal arm ends to resist rotation of the arms as the patient's leg is straightened. The location of the attachment of the straps to the frame member is adjustable to adjust the strap tension. In a preferred embodiment the frame member is a box into which all of the components can be pivoted for storage and which raises the patient's foot above the floor. The front wall of the box is secured to the straps and re-positionable to adjust the strap tension.

13 Claims, 7 Drawing Figures

PORTABLE QUADRICEPS EXERCISER

TECHNICAL FIELD

The present invention relates to exercise devices in general and, more particularly, to devices which permit exercise of the quadriceps muscle.

BACKGROUND OF THE INVENTION

It is widely known that the stability of the knee joint depends primarily on the strength of the quadriceps muscle. It is widely recognized that strengthening and rehabilitation of the quadriceps muscle is best achieved by having a patient straighten his or her knee joint in opposition to a resistive force applied at the patient's instep. Such devices for exercising a quadriceps muscle are found, for example, in U.S. Pat. No. 3,120,954 (Apostol), U.S. Pat. No. 3,558,131 (Dragon), U.S. Pat. No. 4,254,949 (Brentham) and U.S. Pat. No. 4,304,401 (Goodman). The Apostol, Dragon and Brentham devices are relatively large and not readily moved from place to place. Thus, the Apostol and Dragon devices, which are used for exercising muscles other than the quadriceps, are practical only for use in the office of a physical therapist or in such other public exercise facility. The Brentham device, which takes the form of a chair with built in exercising apparatus, is practical for home use but is not sufficiently portable to permit it to be taken with the patient on a trip, or the like. The Goodman device is relatively portable in that it can be readily lifted in one hand and transported by a patient. However, in achieving the desirable portability feature Goodman has sacrificed tension adjustability and other considerations. Specifically, Goodman employs a planar surface supported at approximately chair height in front of a suitable chair. The patient sits in the chair with his leg extending over the planar surface so that the knee bends and the lower part of the leg is suspended. An elastomeric strap is secured to the patient's instep so that the patient may straighten his or her leg against the tension in the strap to exercise the quadriceps muscle. The tension in the strap is not adjustable so that the Goodman arrangement has limited use in view of the varying degrees of muscle strengthening and rehabilitation needs of a user. Moreover, the Goodman apparatus, in use, places relatively high stress on the patient's knee since the greatest tensile stress in the strap occurs when the gravitational force acting on the patient's leg is at a maximum (i.e., as the leg approaches its straightened position). Additional stress is placed on the knee by virtue of the fact that the effective pivot axis of the apparatus is considerably below the bending axis of the knee, resulting in strain on the knee rather than on the quadriceps muscle during the use of this device. In this regard, it should be noted that the only prior art known to me wherein the effective pivot axis of the exercise device is aligned with the bending axis of the knee is the Brentham device. However, in Brentham, as noted above, the apparatus is not sufficiently portable to permit it to be carried from place to place in one hand. In addition, the Brentham device lacks sufficient adjustability in the resistive force against which the patient is exercising. Still further, the Brentham device is designed to exercise both the quadriceps muscle and the hamstring muscle. This is achieved by utilizing an hydraulic element to resist both upward and downward movement of the lower portion of the leg. While a device for exercising both the quadriceps and hamstring muscles is desirable, the use of a single resistive element for both muscles in a single exercise routine presents severe calibration problems. More particularly, it is difficult to find a common resistive force which is suitable for exercising both the hamstring and quadriceps muscles.

SUMMARY OF THE INVENTION

It is therefore an object of the present invention to provide a portable quadriceps exercising device which places minimal strain on the knee joint.

It is another object of the present invention to provide a portable quadriceps muscle exerciser in which the exercise force which must be exerted by the user is readily adjustable to a specific calibration.

It is yet another object of the present invention to provide a portable quadriceps exerciser device which can be readily carried about by a patient and deployed quickly and simply.

It is still another object of the present invention to provide a portable quadriceps exercising device in which the carrying case is an integral part of the device and is capable of storing all of the exercise components therein.

In accordance with the present invention, a portable quadriceps exerciser includes a frame member on which a user sits with one buttock and thigh so that the knee is disposed just forward of the frame member and the lower leg dangles therefrom. The frame member may be a flatboard or the top wall of a box used to store the exerciser components when they are not in use. A pair of brackets project forwardly of the frame member and pivotally support a pair of arm members for pivotal movement about an axis which is substantially coaxial with the bending axis of the user's knee. The distal ends of the arm members are joined by a cross-piece which is aligned with the instep of the user so that the user may rotate the arm members upward and away from the frame member as the user straightens his or her leg. One or more rubber straps are connected between the frame member and the distal ends of the arm members to provide a tension force against movement which opposes straightening of the user's leg. The point of attachment of the rubber straps to the frame member is adjustable so that the tension force is adjustable for different needs. In the preferred embodiment, the front wall of the box is secured to the straps and is mountable at different longitudinal locations to provide the tension adjustability. The height of the box is selected so that, when placed on a conventional chair, it permits the dangling leg of a user to be raised above the floor.

BRIEF DESCRIPTION OF THE DRAWINGS

The above and still further objects, features and advantages of the present invention will become apparent upon consideration of the following details and description of specific embodiments thereof, especially when taken in conjunction with the accompanying drawings, wherein.

DESCRIPTION OF THE PREFERRED EMBODIMENTS

Figures 1, 2, 3, 4, 5:
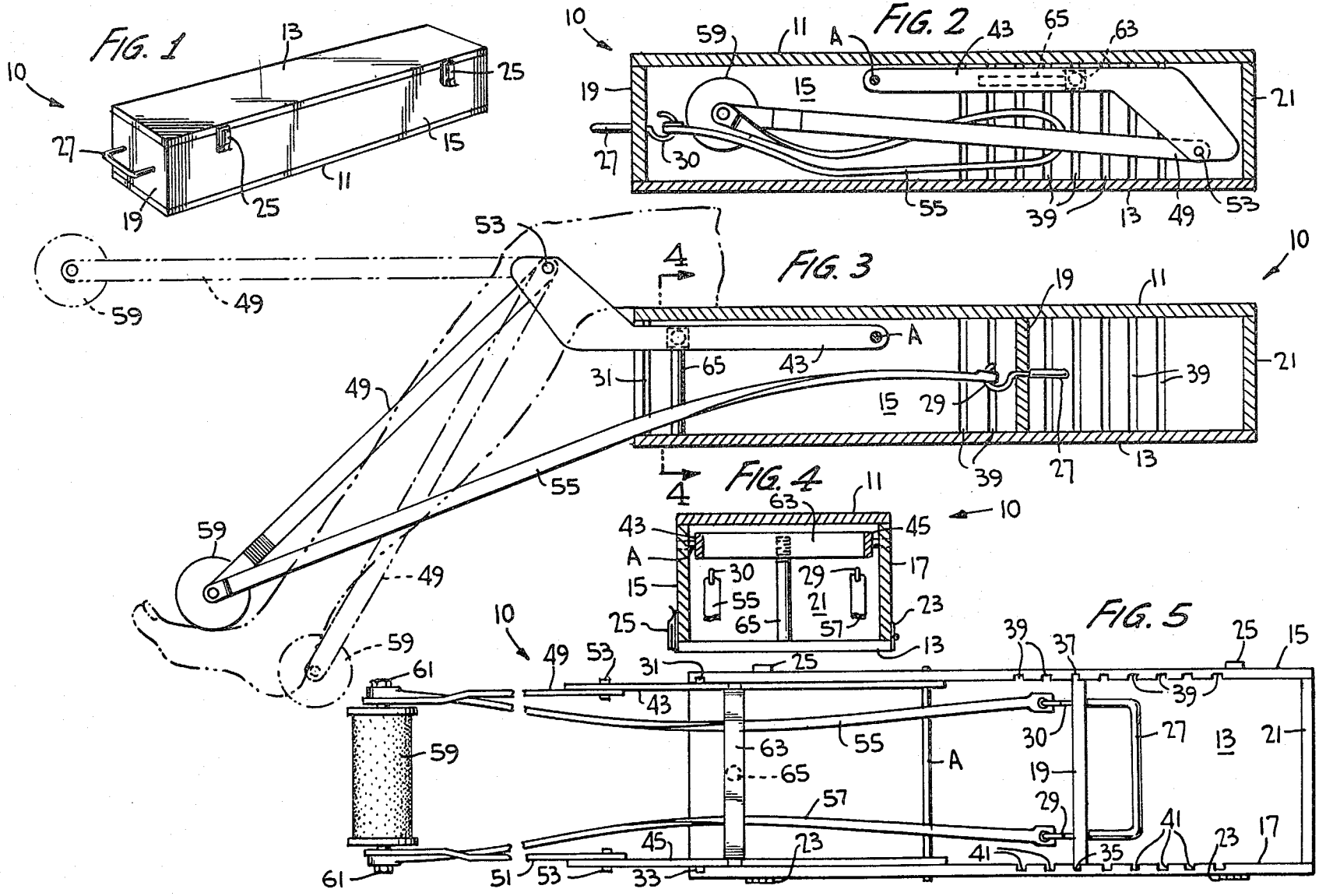
FIG. 1 is a view in perspective of a preferred embodiment of the present invention illustrated in its closed or stored position.
FIG. 2 is a longitudinal sectional view of the embodiment of FIG. 1 shown in its stored or closed condition.
FIG. 3 is a longitudinal sectional view similar to FIG. 2 but wherein the device is shown in its deployed condition.
FIG. 4 is a view in section taken along lines 4—4 of FIG. 3.
FIG. 5 is a top view of the embodiment of FIG. 1 shown with its cover removed.

Referring specifically to FIGS. 1-5 of the accompanying drawings, a portable quadriceps muscle exerciser 10 is housed in an enclosed box having a top wall 11, bottom wall 13, side walls 15 and 17, front end wall 19 and rear end wall 21. The box is illustrated as having rectangular cross-sections in each of its length, width and depth dimensions; however, this is not an important aspect of the invention and cross-sectional variations from rectangular can be employed within the scope of the invention. Bottom wall 13 serves as a cover for the box and is hinged to the bottom portion of side wall 17 by means of hinges 23. A pair of conventional snap-closure latch member 25 are provided at the opposite side of the box to permit the bottom wall cover to be latched closed to side wall 15.

Front wall 19 has an outer surface from which a handle member 27 projects. The handle member 27 permits the box to be easily lifted and carried about in one hand. To this end, the box may be made of rigid lightweight wood, plastic or other composition. A pair of hooks, 29, 30 project upwardly from the interior surface of front wall 19 and are threaded so as to engage respective ends of handle 27 through suitably provided holes in front wall 19. Front wall 19 is removably mounted in the front end position of the box by means of a pair of transversely-aligned channels 31, 33 extending-vertically in side walls 15, 17 respectively. The channels 31, 33 mate with corresponding flanges 35, 37 (see FIG. 5) which project from the front wall 19. Flanges 35, 37 are slidably received in grooves 31, 33 so that front wall 19 can be removed when the cover or bottom wall 13 is open. A plurality of aligned pairs of similar channels 39, 41 are defined in side walls 15, 17, respectively, and are also sized to slidably receive flanges 35, 37 of front wall 19. Each channel pair 39, 41 is disposed at a different distance from the front end of the box so that front wall 19 can be positioned at different distances from the front end, as desired. When positioned in a channel pair 39, 41, front wall 19 faces the opposite direction from its end position in channel 31, 33 so that its interior surface and hooks 29, 30 face the forward direction in the box.

A pair of transversely-spaced elongated bracket members 43, 45 are pivotally mounted at their proximal ends on the interior sides of respective side walls 15, 17 about a common pivot axis A. Pivot axis A may represent an elongated rod extending transversely of the box and secured to the sidewalls 15, 17 in journaled relation with bracket members 43, 45. The bracket members are broadened in the width dimension at their distal ends and pivotally support respective arm members 49, 51 by means of pivot pins 53 or the like. The two pivot pins define a common transverse pivot axis for the arm members 49, 51. Bracket members 43, 45 and arm members 49, 51 are preferably made of steel, aluminum or other similarly strong and relatively lightweight material.

A first strap 55 of rubber or other elastomeric material is secured between the distal end of arm member 49 and hook 29. A second such strap 57 is secured between the distal end of arm member 51 and hook 30. A cross-piece 59 is secured between the distal ends of the two arm members 49, 51 and takes the form of a cushioned roller of the type conventionally employed in prior art exercise devices. The threaded ends of a shaft for roller 59 extend through suitable provided apertures in the distal ends of arm members 49, 51 and straps 55, 57 to be engaged by nuts 61 which secure these elements in place while permitting roller 59 to rotate in a conventional manner.

A strut member includes a cross-bar 63, of rectangular cross-section, journaled at its ends in respective frame members 43, 45. A support rod 65 is threadedly engaged at one of cross-bar 63 and has its other end free.

Bracket members 43, 45 are pivotable about axis A between a stowed or stored position (illustrated in FIG. 2) and a deployed position (illustrated in FIGS. 3 and 5). In the stowed position the bracket members are disposed entirely within the box and arm members 49, 51 are pivoted about pins 53 so that the arm members and roller 59 are likewise disposed entirely within the box. If, as illustrated in FIG. 3, front wall 19 is disposed in channels 31, 33 with the handle 27 facing outward, straps 55 and 57 are also disposed entirely within the box.

In order to rotate the bracket members to the deployed position, cover or bottom wall 13 is unlatched at 25 and opened. Front wall 19 is then removed from channels 31, 33 and the bracket members 43, 45 are pivoted about axis A until their distal ends project out through the front end of the box vacated by front wall 19. This results in arm members 49, 51 and roller 59 being disposed outside the box. Front wall 19 is then disposed in whichever channel pair 39, 41 provides the desired tension on the elastomeric straps 55 and 57 which thereby project out through the open front end of the box.

In order to use the unit for exercising the quadriceps muscle, a patient or user first places the box on a chair or similar flat surface. The patient then sits on the top wall 11 with the buttock and thigh of the leg having the muscle to be exercised. The thigh is longitudinally positioned with respect to the box such that the axis of bending of the knee is substantially co-axially aligned with pivot axis 53 as illustrated in FIG. 3. In this regard, it should be noted that the top or outer surface of top wall 11 is preferably flat, as shown, but may be otherwise contoured so long as it readily accommodates the thigh and buttock of the patient. Likewise, the bottom or outer surface of bottom wall 13 is illustrated as being flat so that it may properly rest without tilt on the seating surface of a chair, bench, or the like; however, variation from flatness may be accommodated as long as the box can be stably supported on a seat. With the patient thusly positioned, the lower part of the leg is placed between arm members 49, 51, so that roller 59 resides at or near the patient's instep, as illustrated in FIG. 3. The patient can then perform a quadriceps muscle strengthening exercise by straightening his or her leg against the tension force applied thereto by elastomeric straps 55, 57 via roller 59. In other words, the patient rotates roller 59 and arm member 49, 51 upward and away from the box (clockwise as viewed in FIG. 3).

As the roller is rotated approximately 90° during the exercise, the opposing tension force effected by straps 55, 57 varies. This is because the direction of the force exerted on the roller 59 by straps 55, 57 varies as the arm members 49, 51 are rotated. More specifically, the direction of the resistant force of the straps is initially considerably displaced from the length dimension arm members 49, 51 so that a relatively large component of the resistant force acts perpendicular to the arm members and in opposition to the patient's upward leg rotation. As the arm members are pivoted upward, the direction of the resultant resistant force of the straps becomes closer to parallel to arm members 49, 51, thereby significantly reducing the perpendicular force component against which the patient is exerting force. Thus, as the patient's leg approaches the straightened position, which is the position of maximum stress on the knee joint, the effect of the resistant force of the straps becomes minimal and the patient's effort is exerted substantially against gravity only. It can be seen, therefore, that where gravity is minimal (i.e., in the 90° bent position of the leg), the effective resistant force of the straps is maximum, and where the effect of gravity is maximum (i.e., the straightened leg position), the effective strap force is minimum. The total force (gravity plus the straps) acting against the patient's efforts is therefore very nearly uniform throughout the 90° straightening of the knee. This desirable feature is not considered or achieved in portable prior art devices for exercising quadriceps muscles.

It should be noted that, when the unit is deployed in the manner illustrated in FIG. 3, a portion of the patient's weight is applied against top wall 11. With front wall 19 moved from the front end of the box to the desired channel pair 39, 41, the patient's weight could cause collapse of the front end of the box. In order to prevent this, the strut member 63, 65 is provided and is positioned along the length of bracket members 43, 45 so as to be located proximate the front end of the box in the deployed position of the unit. In addition, the strut member prevents bracket members 43, 45 from moving vertically when the apparatus is in use.

In addition to serving as self-contained storage compartment for the brackets, arms and straps, the box serves another practical function for the portable exerciser unit. Specifically, the box raises the patient's knee sufficiently above the floor so that the patient's foot is above the floor. The patient can therefore swing his or her leg through a full 90° path without scraping the floor. The typical chair or bench seat is raised eighteen to twenty inches above the floor. Such seats are designed to permit the average adult to sit in the seat with his or her feet touching the floor. The height of the exerciser box is therefore made sufficient to permit the foot of the average sized adult to dangle above the floor when that adult is seated on the box placed on a chair or bench seat. Typically, the height of the box for this purpose is four to five inches.

The arm members 49, 51, as described above, are sized to permit roller 59 to contact the instep of the average sized person. The unit may be provided with alternative pairs of arm members of different lengths to accommodate unusually tall or short people.

In a working embodiment which I have constructed, the following dimensions, materials and parameters were employed. The box was made of finished oak, three-eights of an inch thick, with outside dimensions of twenty inches by seven and three-quarter inches by four and three-quarter inches. Front wall 19 was also finished oak and was one-quarter inch by four inches by seven and three-eighths inches. Eight pairs of channels 39, 41 were three-eighths inch wide, three-sixteenth inch deep and are spaced at successive one inch intervals beginning eleven inches from end wall 21 and extending rearward therefrom. The axial length of bracket members 43, 45 from pivot axis A to pivot axis 53 was eleven and one-quarter inches, and pivot axis 53 is displaced off that axis a distance of two and one-half inches. Arm members 49, 51 are typically fifteen inches long but may be provided in lengths of thirteen and seventeen inches. Straps 55 and 57 were twenty-two inches long. Pivot axis A was disposed fourteen inches from end wall 21. It is understood that those dimensions are pounded by way of example only and are not to be construed as limiting the scope of the present invention.

Figure 6:
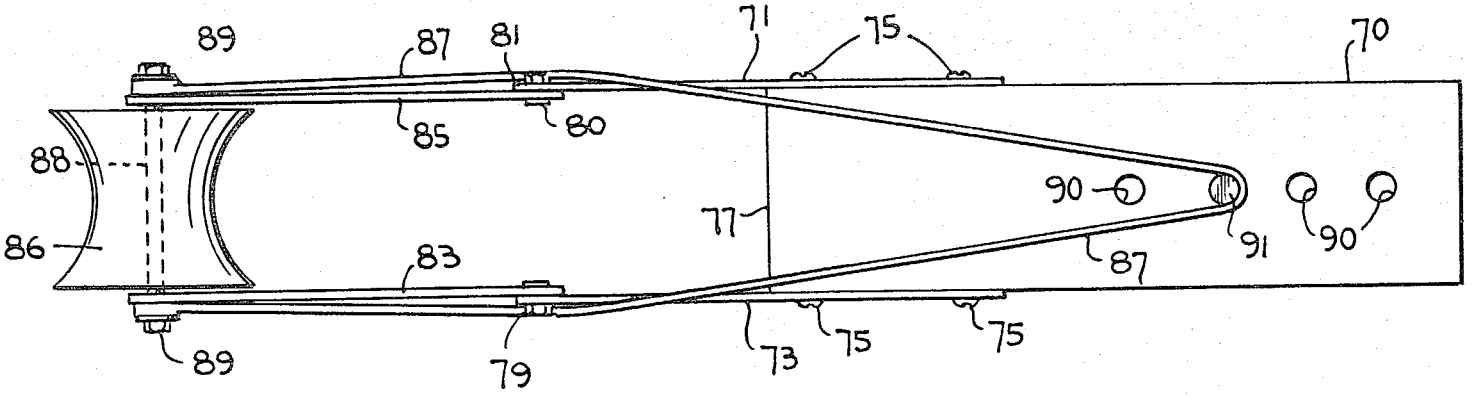
FIG. 6 is a top view in plan of a second embodiment of the present invention.
Figure 7:
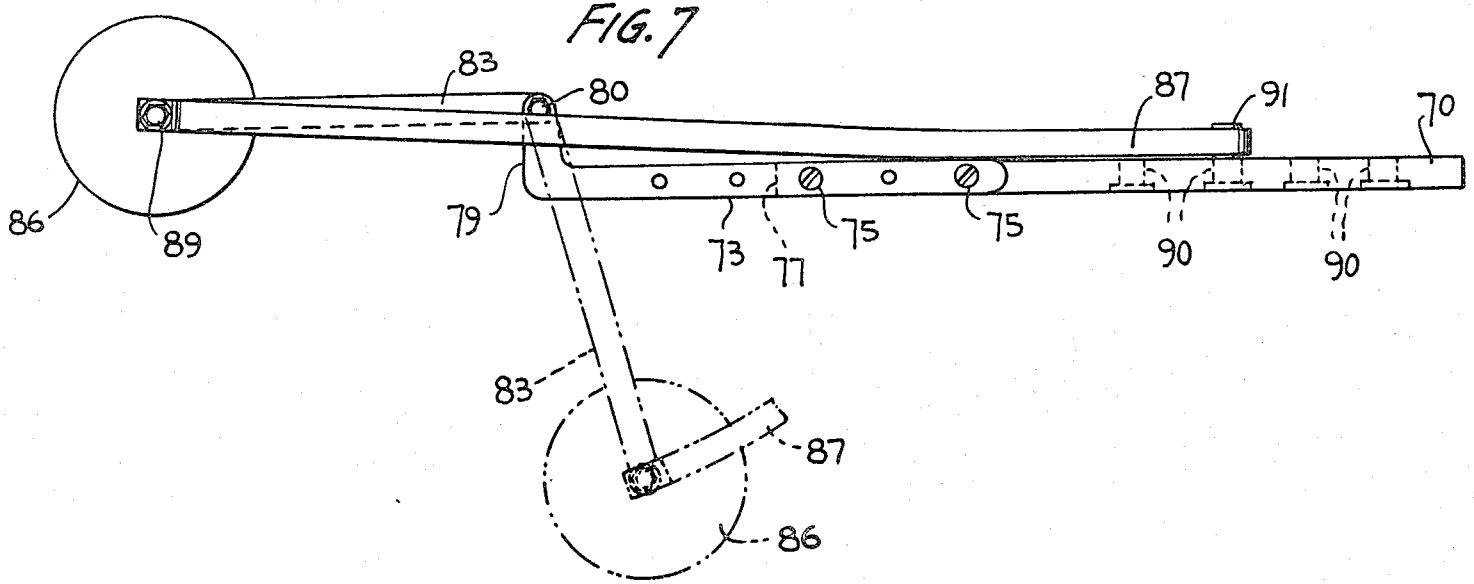
FIG. 7 is a side view of the embodiment of FIG. 6.

An alternative embodiment of the present invention is illustrated in FIGS. 6 and 7 to which express reference is now made. A flat board member 70 is of generally rectangular configuration and similar in size and shape to the top wall 11 of the embodiment of FIGS. 1–5. A pair of bracket members 71, 73 are fixedly secured to the side edges of board 70 by means of screws 75, or the like. The bracket members 71, 73 project beyond the forward edge 77 of the board and terminate in respective right angle flange portions 79, 81 which project upwardly when the apparatus is in use. Arm members 83, 85 are pivotally secured to respective bracket member flange portions 79, 81 so as to pivot about a common axis 80 which is disposed horizontally when the device is in use. A roller 86 is journaled between the distal ends of arm members 83, 85. A rubber strap 87 is secured at its ends to the distal ends of arm members 81, 83 by means of nuts 89 which engage threaded ends of the shaft 88 of roller 86.

A plurality of recesses 90 are spaced in longitudinal alignment along the top surface of board 70. Recesses 90 are each configured to receive a peg member 91. When the peg member is inserted in any of the recesses, a sufficient portion of the peg member projects upwardly from the board member to be engaged by the strap 87. Specifically, the strap 87 extends from the distal end of arm member 81, around peg 91 and back to the distal end of arm 83. The tension in strap 87 can be adjusted by placing the peg 91 in the appropriate recess 90.

In use, board 70 is placed on the seat of a board or bench with the top surface of the board, containing recesses 90, facing upward. The user sits on the board with one buttock and thigh so that the bending axis of his or her knee joint is co-axially aligned with pivot axis 80. In this regard, the upward projection of flange members 79, 81 permits this alignment of axes. Operation then proceeds in the same manner described above for the embodiment of FIGS. 1–5.

The embodiment of FIGS. 6 and 7 may, in some cases, not raise the patient's knee high enough so that the foot of the patient is not raised above the floor when the board is placed on the seat of a chair or bench. To overcome this, any suitable means of elevating the board on the chair, such as telephone books, etc., may be employed. Alternatively, the board may be provided with legs, such as telescopically retractable legs, which are capable of raising the board sufficiently.

While I have described and illustrated various specific embodiments of my invention, it will be clear that variations from the details of construction which are specifically illustrated and described may be resorted to without departing from the true spirit and scope of the invention as defined in the appended claims.

What I claim is:

1. Apparatus for exercising the quadriceps muscle of a patient, said apparatus comprising:

a support member which is sufficiently portable as to be easily and conveniently carried about in one hand by said patient, said support member including: a bottom portion adapted to be supported by a flat support surface; a forward end; and a top surface adapted to support a buttock and the back of a thigh of said patient such that the patient's knee joint extends beyond said forward end;

a pair of bracket members secured to said suppot member to extend longitudinally forward of said forward end in transversely spaced relation on opposite sides of said patient's knee joint;

a pair of substantially parallel transversely-spaced arm members, each pivotally attached to a respective bracket member to define a pivot axis which is substantially co-axially aligned with the axis of rotation of the knee joint of the patient, said arm members each having a length at least equal to the length of a lower leg portion of the patient;

a cross-piece member extending transversely between said arm members at a location which is spaced from said pivot axis such that it contacts the instep of the patient's foot when the patient's knee joint is aligned with said pivot axis;

elastomeric strap means secured to said arm members and to said support member for elastically resisting pivotal movement of said arm members about said pivot axis in a forward and upward direction;

adjustable means for selectively adjusting the elastic resistance presented by said elastomeric strap means;

wherein said elastomeric strap means includes two lengths of elastic strap, each length having a first point along its length secured to said first and second arm members, respectively, and wherein said adjustable means includes further means for securing said strap length at different locations along said support member; and wherein said support member is an enclosure having a cover which can be selectively opened, and a forward end wall which is selectively removable, wherein said bracket members are pivotally mounted inside said enclosure between stowed and deployed positions, said stowed position being such that said bracket members, arm members, cross-piece member and strap lengths are disposed within said disclosure, said deployed position being such that said bracket member projects forwardly beyond said removed forward end wall and said arm members, cross-piece member and straps are located outside said enclosure.

2. The apparatus according to claim 1;

wherein said forward end wall has an interior surface;

wherein said intermediate point of said strap is secured to said interior surface;

wherein said further means includes a plurality of longitudinally-spaced recesses defined in said enclosure, each recess being adapted to receive said forward end wall with said interior surface facing the forward end of said enclosure.

3. The apparatus according to claim 2 wherein said enclosure is a box having top and bottom walls, two side walls, said front end wall and a rear end wall, wherein said top wall has a flat outer surface corresponding to said top surface, wherein said bottom wall has a flat outer surface corresponding to said bottom portion and is hinged to one of said side walls to serve as a cover, and wherein the depth of said box from top to bottom is less than the length of said arm members and sufficiently great to raise the foot of a patient above a floor when the apparatus is in use and placed on a seat which is approximately 18 to 20 inches above the floor.

4. The apparatus according to claim 3 further comprising strut means pivotally secured between said bracket members for structurally supporting said top wall above said bottom wall when said bracket members are in said deployed position.

5. Apparatus for exercising the quadriceps muscle of a patient, said apparatus comprising:

an enclosure including a top wall, a bottom wall, a front wall and side walls, said enclosure being sufficiently portable to permit a patient to lift it and conveniently carry it about with one hand, said enclosure including means for removably engaging said front wall in said side walls such that said front wall can be easily removed from said enclosure;

a pair of transversely spaced bracket members having first and second ends;

mounting means for mounting said bracket members inside said enclosure proximate said first ends such that said bracket members are selectively movable between stored and deployed positions, said bracket member in said stored position residing entirely within said enclosure, said bracket members in said deployed position being positioned with their second ends projecting forwardly of said enclosure beyond the engaged location of the removed front wall;

a pair of transversely-spaced arm members having first and second ends, each arm member having its first end pivotally engaged to a respective bracket member proximate the second end of said bracket member to permit simultaneous free pivotal movement of said arm members about a common pivot axis, said arm members being sufficiently short so as to be retained within said enclosure when said bracket members are in said stored position, said arm members having a length sufficient to extend from the knee joint to the instep of a patient using the apparatus;

cross-piece means extending transversely between said arm members proximate the second end of said arm members; and elastomeric means secured between said arm members and said enclosure to resist pivotal movement of said arm members about said pivot axis in a direction upward and away from said enclosure when said bracket members are in said deployed position.

6. The apparatus according to claim 5 wherein one of said top and bottom walls constitutes a selectively openable cover for providing access to the enclosure interior, wherein said front wall provides structural support for said top wall against said bottom wall and is removable from engagement in said side walls only when said cover is open.

7. The apparatus according to claims 5 or 6 further comprising adjustable means for selectively adjusting the resistance to pivotal movement provided by said elastomeric means.

8. The apparatus according to claim 6 wherein said mounting means comprises pivotal mounting means to permit selective pivotal movement of said bracket members between said stored and deployed positions when said cover is open.

9. The apparatus according to claims 6 or 8;

wherein said means for removably engaging said front wall includes vertically-extending and transversely-aligned channels defined in said side walls and transversely-projecting flanges defined in said front wall for mating with said channels;

wherein said front wall has an interior surface and said elastomeric means comprises elastomeric strap means secured between said interior surface of said front wall and the second ends of said arm members; and wherein each of said side walls is provided with plural vertically-extending channels transversely aligned with a corresponding channel in the other of said side walls, said channels being configured to selectively receive said front wall in each pair of aligned channels at different spaced distances from the second ends of said arm members to selectively increase the resistive force applied via said strap means on said arm members.

10. The apparatus according to claim 9 further comprising strut means engaged between said bracket members for providing structural support between said top and bottom walls when said bracket members are in said deployed position.

11. The apparatus according to claim 10 wherein the height of said enclosure from top to bottom is such that when the bottom wall is placed on a seat which is approximately eighteen inches off the ground, a patient can sit in exercise position on the top wall with one buttock and thigh so that the foot and leg portions below the patient's knee can be dangled from between the deployed bracket members without touching the ground.

12. The apparatus according to claim 11 wherein the bending axis of a patient's knee joint, in said exercise position, is substantially coaxially aligned with said pivot axis.

13. The apparatus according to claim 5 wherein a patient uses the apparatus by sitting on the top wall with one buttock and corresponding thigh such that the leg portion below the knee joint can dangle from the enclosure and such that the bending axis of the patient's knee joint is substantially coaxially aligned with said first pivot axis.

* * * * *